US008678713B2

(12) United States Patent
Onda et al.

(10) Patent No.: US 8,678,713 B2
(45) Date of Patent: Mar. 25, 2014

(54) HAT-TYPE STEEL SHEET PILE

(75) Inventors: Kunihiko Onda, Kawasaki (JP); Kenji Kono, Kawasaki (JP); Shunsuke Usami, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 48 days.

(21) Appl. No.: 13/560,312

(22) Filed: Jul. 27, 2012

(65) Prior Publication Data

US 2013/0195561 A1 Aug. 1, 2013

(51) Int. Cl.
*E02D 5/04* (2006.01)

(52) U.S. Cl.
USPC ..... 405/276; 405/277

(58) Field of Classification Search
USPC ..... 405/276, 277
See application file for complete search history.

(56) References Cited

U.S. PATENT DOCUMENTS 5,447,393 A * 9/1995 Yeates et al. ..... 405/276
6,939,086 B2 * 9/2005 Nishiumi et al. ..... 405/277

FOREIGN PATENT DOCUMENTS

| | | | |
|---|---|---|---|
| JP | 2004-162458 | A | 6/2004 |
| JP | 2004-162460 | A | 6/2004 |
| JP | 2005-048394 | A | 2/2005 |
| JP | 2005-213895 | A | 8/2005 |
| JP | 2008-069631 | A | 3/2008 |

* cited by examiner

*Primary Examiner* — Thomas B Will
*Assistant Examiner* — Katherine Chu
(74) *Attorney, Agent, or Firm* — RatnerPrestia

(57) ABSTRACT

The present invention provides a hat-type steel sheet pile whose economic efficiency, workability, and integrity are all optimized. In the hat-type steel sheet pile according to the present invention, web portions are continuously formed at both ends of an upper flange portion, and lower flange portions are formed at respective end portions of a pair of web portions. A relationship among geometrical moment of inertia I per 1 m of wall width ($cm^4/m$) when forming a steel sheet pile wall, weight per unit wall area W ($kg/m^2$), penetration resistance R, and web angle θ (°) is set to satisfy one of several expression groups.

4 Claims, 8 Drawing Sheets

HAT-TYPE STEEL SHEET PILE

FIELD OF THE INVENTION

The present invention relates to a hat-type steel sheet pile which is used for an underground retaining wall, or a river embankment, etc.

In this description, the hat-type steel sheet pile means a steel sheet pile in which web portions are continuously formed at both ends of an upper flange portion, and lower flange portions are formed at respective end portions of a pair of web portions, so that its whole shape becomes substantially hat-like in shape.

BACKGROUND OF THE INVENTION

As a performance indicator of a steel sheet pile wall constructed by fitting together joints of steel sheet piles, there is a geometrical moment of inertia (I) which shows rigidity of the wall. In general, when the geometrical moment of inertia (I) becomes large, an amount of deformation of the wall body when some load, such as earth pressure or water pressure, is applied thereon becomes small.

The geometrical moment of inertia (I) can be made larger by increasing the steel sheet thickness (t) and height (H) of the steel sheet pile, but the cross-sectional area (A) is desired to be made smaller so as to decrease the steel weight (W) from the economical point of view.

On the other hand, when the size of steel sheet pile is enlarged, penetration resistance (R) of the steel sheet pile is made to be increased. The penetration resistance (R) is a major indicator which affects the workability (penetration performance) of the steel sheet pile, and is desired to be made small. Namely, when the penetration resistance (R) is small, the penetration speed of the steel sheet pile and the penetration performance are made to be improved.

The penetration resistance (R) of the steel sheet pile is mainly made of supporting force due to ground resistance and joint resistance. Among them, the supporting force due to ground resistance (distal end+circumferential surface friction) can be artificially lowered to some extent by temporarily lowering the strength of the ground by using a supplementary construction method, such as a water jet construction method.

On the other hand, the joint resistance is caused by frictional resistance between joints themselves, or a joint and soil in the joint.

Usually, because a gap of a few millimeters or below is set between joints, as long as a steel sheet pile is installed under a state of being completely parallel with the previously installed steel sheet pile, theoretically, there must be substantially no friction between the joints themselves.

However, actually the steel sheet pile is not a rigid body so that its cross section gradually deforms by the supporting force due to the ground resistance so as to generate deflection. As a result, the joints are brought into contact with each other so as to generate friction.

Note that, there is a method of applying lubricant on the joint for decreasing the frictional resistance, but its effect is limited because the lubricant is exfoliated by the friction with the joint or soil.

When the joint resistance is generated, there is formed a vicious circle that the steel sheet pile is inclined so as to further increase the friction.

Once such vicious circle has been generated, it is difficult to correct the same. Accordingly, for example, a guide frame is used for preventing the steel sheet pile to be installed from being inclined, and if an inclination or an misalignment is caused, the steel sheet pile is pulled out and installed again.

With respect to such inclination or misalignment of the steel sheet pile, there is a way to suppress the joint resistance by strictly setting the standard of working management, but this simultaneously causes lowering of the working performance.

Moreover, the cause of increasing the frictional resistance due to the deformation of the cross section of the steel sheet pile has not been removed yet, and even when the pulled out steel sheet pile is installed again, this problem cannot be addressed.

As mentioned above, regarding the setting of the cross-sectional shape of steel sheet pile, the economic efficiency and the workability should be taken into account, and in this regard, some methods of setting the cross-sectional shape of the hat-type steel sheet pile are described in, for example, the following Patent Literatures 1 to 5.

Patent Literatures 1 and 2 describe methods of setting a shape for obtaining a cross-sectional performance superior to those of conventional U-type steel sheet pile or a broad steel sheet pile by satisfying both newly defined relational expressions, one is about the flange width (Bf) and the effective width (B), and the other is about the geometrical moment of inertia (I), the height (H), and the effective width (B).

On the other hand, Patent Literature 3 describes a hat-type steel sheet pile whose penetration resistance (R) is minimized by limiting the range of the web angle θ based on a relational expression of the geometrical moment of inertia (I). Similarly, Patent Literature 5 describes a hat-type steel sheet pile which ensures the penetration performance whose setting is made so as to satisfy a relational expression of the geometrical moment of inertia (I), the effective width (B), and the unit weight (W).

Likewise, Patent Literature 4 describes a hat-type steel sheet pile having an enhanced economic efficiency which can be obtained by satisfying both relational expressions, one is about the geometrical moment of inertia (I) and the unit weight (W) of a hat-type steel sheet pile which is set so as to exceed the linear relation of the unit weight (W) and the geometrical moment of inertia (I) of the conventional U-type steel sheet pile, the other is about the effective width (B) and the flange width (Bf).

These hat-type steel sheet piles are directed to those having the effective width (B) of 700 to 1200 mm, the height (H) of about 200 to 350 mm, and the geometrical moment of inertia (I) of about 10,000 to 20,000 $cm^4/m$.

PATENT LITERATURE

Patent Literature 1: Japanese Patent Application Laid-Open (JP-A) No. 2008-069631
Patent Literature 2: Japanese Patent No. 4069030
Patent Literature 3: Japanese Patent No. 3488233
Patent Literature 4: Japanese Patent No. 3458109
Patent Literature 5: JP-A No. 2005-213895

SUMMARY OF THE INVENTION

The above-mentioned Patent Literatures 1 to 5 are focused on one of the economic efficiency and the penetration performance (workability) in setting the cross-sectional shape of hat-type steel sheet pile, and their considerations are specialized therein.

However, these methods of setting a shape of steel sheet pile do not optimize both the economic efficiency and the workability under a clear concept. As far as the present inventors know, there is no Literature which discloses a hat-type steel sheet pile whose economic efficiency, workability and integrity are all optimized.

In order to enhance the economic efficiency, the steel weight per cross-sectional performance should be decreased as low as possible, and there is considered a method of decreasing the steel sheet thickness while enlarging the cross section. However, it is apparent that the penetration resistance during working increases if the cross section is enlarged. Moreover, if the steel sheet thickness is thinned, damages, such as local buckling, may be caused during working or conveyance, so that the performance of the steel sheet pile may be deteriorated.

The present invention is intended to solve the above-mentioned problems, and provide a hat-type steel sheet pile whose economic efficiency and workability are both optimized, and integrity is also ensured.

The present inventors thought of introducing economic efficiency indicators which are defined as A/I or W/I, where A is the cross-sectional area per 1 m of wall width, W is the weight per unit wall area, and I is the geometrical moment of inertia per 1 m of wall width. For the economic efficiency, these economic efficiency indicators are desired to be made as small as possible. Namely, taking into account manufacturing cost etc., a cross-sectional area (A) and a unit weight (W) necessary for obtaining a given geometrical moment of inertia (I) become more economical when the economic efficiency indicators thereof are made smaller.

Note that, while the conventional U-type steel sheet pile of III-type with a width of 400 mm has W/I=150/16,800=$8.9\times10^{-3}$, the enlarged broad steel sheet pile of IIIw-type with a width of 600 mm has W/I=136/32,400=$4.2\times10^{-3}$. The economic efficiency of the latter has been improved to be more than doubled in comparison to the former.

As mentioned above, if the cross-sectional performance of the steel sheet pile wall (the geometrical moment of inertia (I) or the section modulus (Z)) is the same, as the weight per unit wall area (W) becomes lower, the economic efficiency is further improved (the steel material weight with respect to the same cross-sectional performance is decreased). Namely, if the manufacturing cost per unit weight is the same, as the weight per cross-sectional performance (W/I) becomes lower, the economic efficiency is further improved.

On the other hand, if the weight per cross-sectional performance (W/I) decreases, the cross-sectional size of the steel sheet pile (the effective width (B) and the height (H)) increases, and the steel sheet thickness (t) decreases. As a result, the amount of deformation of the steel sheet pile during working increases so that the installation becomes difficult. Accordingly, when W/I is large, the workability is good, namely, the penetration resistance (R) is small.

Therefore, when W/I (nearly equal to manufacturing cost) decreases, the penetration resistance (R) (nearly equal to working cost) increases. On the contrary, when W/I increases, the penetration resistance (R) decreases. Namely, W/I and R have a relationship of antinomy. Therefore, it is desirable for optimizing both the economic efficiency and the workability that how W/I as the economic efficiency indicator and R as the workability indicator should be balanced.

The present invention has been made taking into account the above-mentioned findings so as to include the following exemplary configurations.

(1) The present invention provides a hat-type steel sheet pile in which web portions are continuously formed at both ends of an upper flange portion, and lower flange portions are formed at respective end portions of a pair of web portions, wherein a relationship among a geometrical moment of inertia I per 1 m of wall width ($cm^4/m$) when forming a steel sheet pile wall, a weight per unit wall area W ($kg/m^2$), a penetration resistance R, and a web angle θ (°) is set to satisfy one of following expression groups (A) and (B).

The Expression Group (A):

$$(W/I)\times R\leq 0.004 \text{ and}$$

$$2.65\times10^{-4}\times I+22\leq\theta\leq 2.80\times10^{-4}\times I+48(20{,}000\leq I<80{,}000)$$

$$2.65\times10^{-4}\times I+22\leq\theta\leq 70(80{,}000\leq I<180{,}000)$$

The Expression Group (B):

$$0.004<(W/I)\times R\leq 0.0075 \text{ and}$$

$$2.80\times10^{-4}\times I+44.6<\theta\leq 80(20{,}000\leq I<80{,}000)$$

$$67<\theta\leq 80(80{,}000\leq I<200{,}000)$$

(2) The present invention provides a hat-type steel sheet pile in which web portions are continuously formed at both ends of an upper flange portion, and lower flange portions are formed at respective end portions of a pair of web portions, wherein a relationship among a geometrical moment of inertia I per 1 m of wall width ($cm^4/m$) when forming a steel sheet pile wall, a weight per unit wall area W ($kg/m^2$), a penetration resistance R, and a web angle θ (°) is set to satisfy the above expression group (A).

(3) The present invention provides a hat-type steel sheet pile in which web portions are continuously formed at both ends of an upper flange portion, and lower flange portions are formed at respective end portions of a pair of web portions, wherein a relationship among a geometrical moment of inertia I per 1 m of wall width ($cm^4/m$) when forming a steel sheet pile wall, a weight per unit wall area W ($kg/m^2$), a penetration resistance R, and a web angle θ (°) is set to satisfy the above expression group (B).

(4) The present invention provides the hat-type steel sheet pile according to any one of the above items (1) to (3), wherein a relationship between the height (H) and the web steel sheet thickness (tw) satisfies a following expression.

$$H/tw\leq 60.0$$

In exemplary embodiments of the present invention, when the steel sheet pile wall is made, the relationship among the geometrical moment of inertia I per 1 m of wall width ($cm^4/m$), the weight per unit wall area W ($kg/m^2$), the penetration resistance R, and the web angle θ (°), is set so as to satisfy the above-mentioned expression groups (A) or (B). Accordingly, the hat-type steel sheet pile can satisfy both the economic efficiency and the workability, and further enhance the workability.

In embodiments of the present invention, in addition to those mentioned above, because the relationship between the height (H) and the web steel sheet thickness (tw) is set so as to satisfy the following expression, the buckling/deformation of the steel sheet pile due to the penetration resistance during working can be suppressed, thereby, a hat-type steel sheet pile whose integrity has been ensured can be provided.

$$H/tw\leq 60.0$$

DESCRIPTION OF EMBODIMENTS

Figure 1:
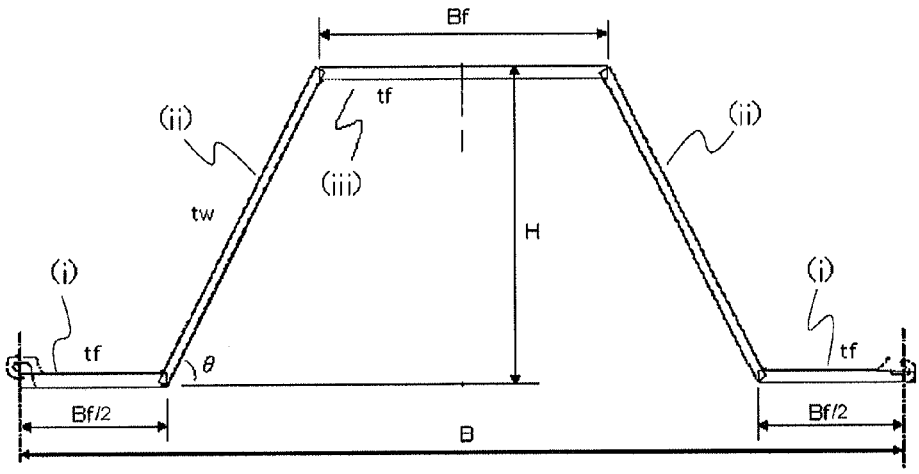
FIG. 1 is a schematic diagram illustrating a hat-type steel sheet pile according to an embodiment of the present invention.

Regarding the hat-type steel sheet pile according to the embodiment of the present invention illustrated in FIG. 1, a method of determining its shape is described.

As parameters for determining a cross-sectional shape of the hat-type steel sheet pile, there are the effective width (B), the height (H), the web angle (θ), the flange width (Bf), the flange steel sheet thickness (tf), and the web steel sheet thickness (tw).

When these parameters are determined, the weight per unit wall area (W) and the geometrical moment of inertia (I) per 1 m of wall width are unambiguously determined based on the following expressions.

$$I=I_0+\Sigma A\times y^2$$

$$W=\gamma\times A$$

($I_0$: geometrical moment of inertia; A: cross-sectional area; y: distance from centroid axis; γ: weight per unit volume)

Usually, regarding the geometrical moment of inertia (I) of the steel sheet pile, its exact solution including the joint portion is calculated based on the above-mentioned expressions by using CAD data of the steel sheet pile cross section.

However, when examining the cross-sectional shape of this embodiment, or the like, namely, when doing parametric study, it is extremely complicated to prepare CAD data every time before calculating I.

Therefore, the following method has been considered for calculating the geometrical moment of inertia (I) of the steel sheet pile wall.

As illustrated in FIG. 1, the hat-type steel sheet pile cross section was divided into three portions including the upper and lower flanges and the webs so that a method capable of simply calculating I was used, although it is a rough estimate. However, this method does not take into account the joint portions so that the value of I is calculated to be smaller thereby. According to a trial calculation, the value is about 80 to 90% of the exact solution, but this is not a problem because this point is taken into account when the straight line defining the shape mentioned below is determined by fitting.

As mentioned above, generally, the geometrical moment of inertia (I) can be expressed as follows.

$$I=I_0+\Sigma A\times y^2$$

Here, when the hat-type steel sheet pile is divided into three rectangles ((i), (ii), (iii)) as illustrated in FIG. 1, respective I is determined to be expressed as follows. Note that, (i) is treated as one rectangle by including the right and left rectangles.

$$\text{(i)(iii): } I=\{Bf\times tf^3/12+Bf\times tf\times(h/2)^2\}\times 2 \quad \text{[Equation 1]}$$
$$=Bf\times tf/2\times(tf^2/3+h^2)$$

$$\text{(ii): } I=\int_0^{h/2}[(\Delta h/\sin\theta\times tw)\times h^2]\times 2\times 2$$
$$=2\times tw/\sin\theta\times[h^3/3]_0^{h/2}\times 2$$
$$=tw\times h^3/6\times 1/\sin\theta$$

With this, I' per one hat-type steel sheet pile is expressed as a following expression.

$$I'=Bf\times tf/2\times(tf^2/3+h^2)+tw\times h^3/6\times 1/\sin\theta$$

Accordingly, the geometrical moment of inertia (I) per 1 m of wall width is expressed as the following expression (1).

$$I=(Bf\times tf/2\times(tf^2/3+h^2)+tw\times h^3/6\times 1/\sin\theta)\times 1000/B \quad (1)$$

According to this expression (1), the geometrical moment of inertia (I) can be easily calculated from the effective width (B), the height (H=h+tf), the web angle (θ), the flange width (Bf), the flange steel sheet thickness (tf), and the web steel sheet thickness (tw), which are parameters defining the cross-sectional shape of the hat-type steel sheet pile.

Similarly, the weight per unit wall area (W) can also be calculated by the expression (2).

$$W=(Bf\times tf+h\times tw/\sin\theta)\times 2\times\gamma\times 1000/B \quad (2)$$

Note that, the flange width (Bf) is expressed as the following expression.

$$Bf=B/2-h/(2\times\tan\theta)$$

Figure 2:
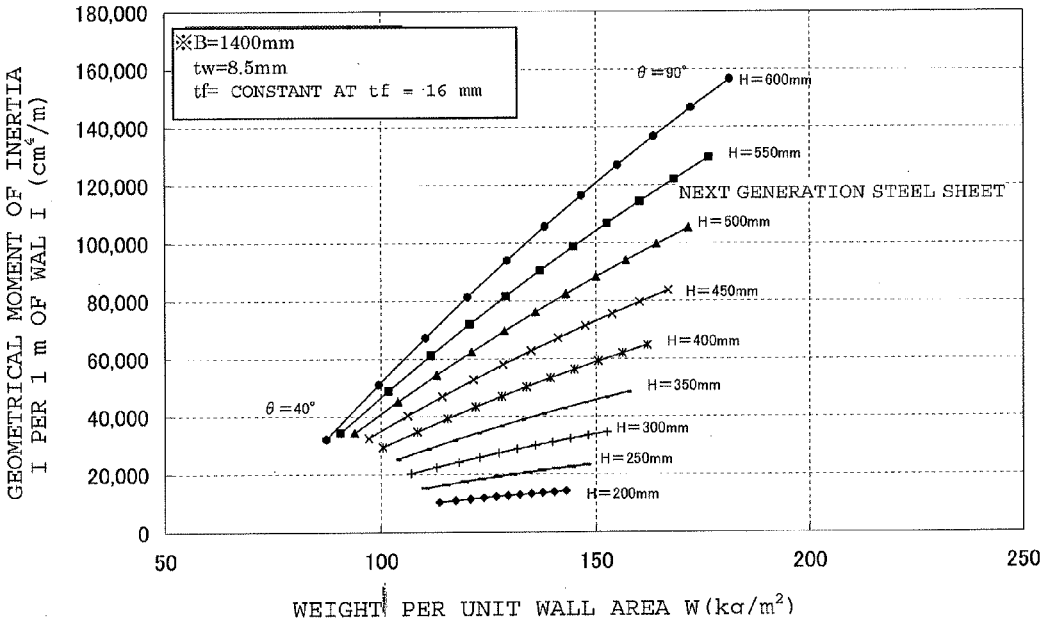
FIG. 2 is a graph for explaining a process for determining a cross section in an embodiment of the present invention, the graph showing the relationship between the geometrical moment of inertia per 1 m of wall width and the weight per unit wall area, while changing the height (H) and the web angle (θ), where B=1400 mm, tf=16 mm, and tw=8.5 mm, all of which are constant.

FIG. 2 shows an example of I and W obtained by a trial calculation using the expressions (1) and (2). In FIG. 2, the vertical axis denotes the geometrical moment of inertia I per 1 m of wall width ($cm^4/m$), and the horizontal axis denotes the weight per unit wall area W ($kg/m^2$).

In this example, B=1400 mm, tf=16 mm, and tw=8.5 mm, all of which are constant, and the height (H) and the web angle (θ) are changed.

As shown in FIG. 2, it can be seen that, as the height (H) and the web angle (θ) increase, the geometrical moment of inertia (I) increases. Specifically, because the height (H) greatly contributes to the increase of I, the economic efficiency is effectively enhanced by increasing H, as long as the steel sheet pile can be manufactured, and an appropriate workability can be ensured.

Figure 3:
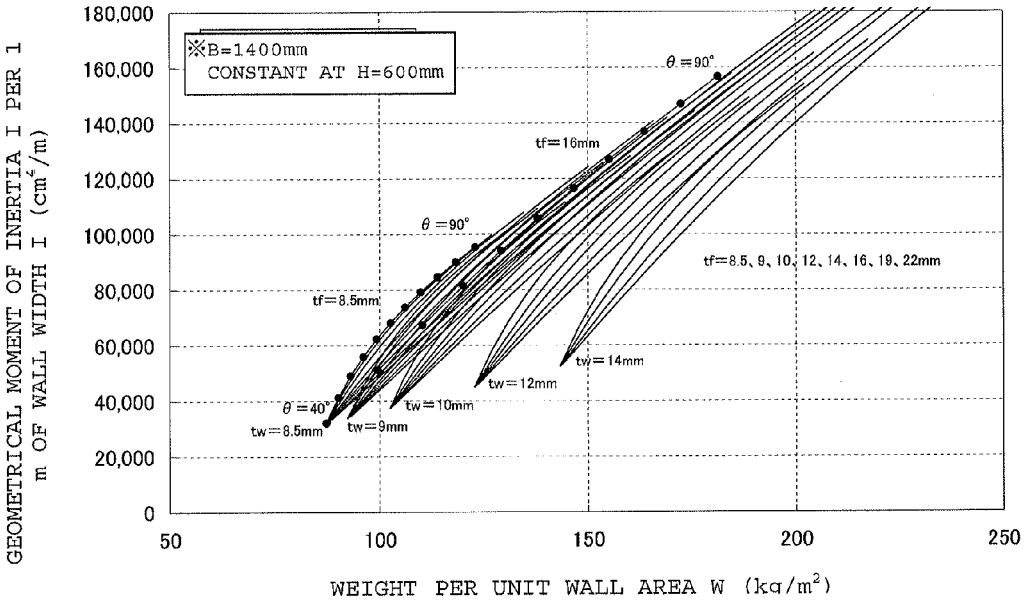
FIG. 3 is a graph for explaining a process for determining a cross section in an embodiment of the present invention, the graph showing the relationship between the geometrical moment of inertia per 1 m of wall width and the weight per unit wall area, while changing the flange steel sheet thickness (tf) and the web steel sheet thickness (tw), where B=1400 mm and H=600 mm, both of which are constant.

Moreover, FIG. 3 shows an example of I and W obtained by a trial calculation using the expressions (1) and (2), where B=1400 mm and H=600 mm, both of which are constant, and the flange steel sheet thickness (tf) and the web steel sheet thickness (tw) are changed.

In FIG. 3, tw is changed to 8.5 mm, 9 mm, 10 mm, 12 mm, and 14 mm, and tf is changed to 8.5 mm, 9 mm, 10 mm, 12 mm, 14 mm, 16 mm, 19 mm, and 22 mm, under the condition tf≥tw. In the graph of FIG. 3, each curve in the bundle of curves extending upward to the right from each tw shows tf which can be obtained at the given tw.

In FIG. 3, the influences of the flange steel sheet thickness (tf) and the web steel sheet thickness (tw) on I can be identified. Namely, while B=1400 mm and H=600 mm, both of which are constant, due to the term of square of the distance y from the centroid axis in the expression of the geometrical moment of inertia, the increase of the flange steel sheet thickness (tf) far from the centroid axis has a large effect.

For example, focusing on θ=90° at tw=8.5 mm, I=95,000 ($cm^4/m$) when tf=8.5 mm, and I=155,000 ($cm^4/m$) at tf=16 mm. On the other hand, as apparent from FIG. 3, I is not greatly changed, even when tw is changed.

Therefore, I can be effectively increased by increasing tf, and decreasing tw.

Note that, at a given I on the vertical axes of FIGS. 2 and 3 (for example, I=100,000 $cm^4/m$), the horizontal axes intersect multiple lines. Accordingly, there can be found a variety of specifications of hat-type steel sheet piles which exhibit the same geometrical moment of inertia (I) according to the height (H), the web angle (θ), the flange steel sheet thickness (tf), and the web steel sheet thickness (tw).

Then, as a product configuration of the hat-type steel sheet pile, assuming that there are nine types of I=20,000, 40,000, 60,000, 80,000, 100,000, 120,000, 140,000, 160,000, and 180,000, based on the parameters shown in Table 1 described below, the specifications capable of exhibiting respective I were determined. Note that, the effective width (B) was set at 1400 to be constant here for simplification, it is apparent that the effective width (B) can be treated as a parameter for examination as long as its manufacturing is possible.

TABLE 1

| B (mm) | H (mm) | θ (°) | tf (mm) | tw (mm) |
|---|---|---|---|---|
| 1400 | 250 | 30.0 | 8.5 | 8.5 |
| | 300 | 31.0 | 9.0 | 9.0 |
| | 350 | 32.0 | 10.0 | 10.0 |
| | 400 | ~ (1° PITCH) | 12.0 | 12.0 |
| | 450 | 88.0 | 14.0 | 14.0 |
| | 500 | 89.0 | 16.0 | |
| | 550 | 90.0 | 19.0 | (tw ≤ tf) |
| | 600 | | 22.0 | |

Regarding the thus determined multiple specifications of the hat-type steel sheet piles mentioned above, the following examination was performed in order to set the cross-sectional shape of the hat-type steel sheet pile such that both the economic efficiency and the workability were optimized.

Figure 4:
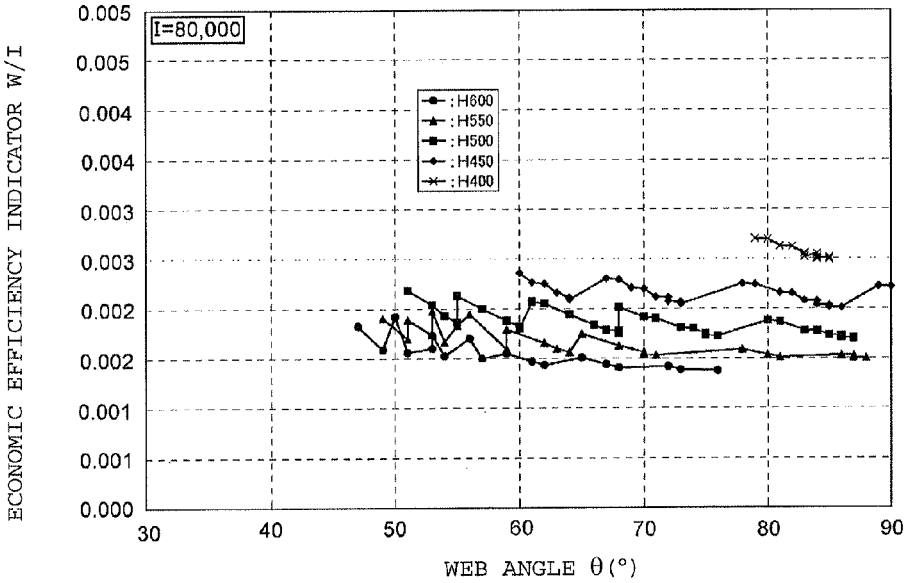
FIG. 4 is a graph for explaining a process for determining a cross section in an embodiment of the present invention, the graph showing the relationship between the economic efficiency indicator and the web angle, where I=80,000.

FIG. 4 is a graph showing the relationship between the economic efficiency indicator (W/I) and the web angle (θ) at respective heights (H=600, 550, 500, 450) for an example of hat-type steel sheet pile having I=80,000 ($cm^4/m$). The vertical axis denotes the economic efficiency indicator (W/I), and the horizontal axis denotes the web angle (θ).

In the graph shown in FIG. 4, for respective flange steel sheet thickness (tf) shown in Table 1, while the web angle (θ) is gradually increased, the web steel sheet thickness (tw) is decreased, so that the weight is decreased while ensuring I=80,000 ($cm^4/m$). Then, when I=80,000 ($cm^4/m$) could not be ensured, tf was ranked down to the next tf, and tw was ranked up, and this process was repeated. Therefore, the graph of FIG. 4 becomes a saw-toothed graph downward to the right.

According to the graph of FIG. 4, when focusing on the straight line for each tf, there is a tendency that as the web angle (θ) increases, the economic efficiency indicator (W/I) decreases, so that the economic efficiency is improved.

Like this, there can be found a close relationship between the web angle (θ) and the economic efficiency indicator (W/I).

On the other hand, the workability indicator (penetration resistance (R)) is defined by the following expression (3). The expression (3) is an example of expression showing the penetration resistance obtained by an in-house installation experiment of a steel sheet pile model, and the above-mentioned Patent Literature 3 also describes the similar expression.

$$R=\tan\theta\times H\times 2/Bf \quad (3)$$

By observing the expression (3), the generations of the following phenomena can be understood.

- When the web angle (θ) increases, the web rises up, thereby, the earth pressure is concentrated in the groove of the steel sheet pile so that the steel sheet pile becomes to be easily deformed, thereby lowering the penetration performance.
- When the height (H) increases, the ground resistance increases, thereby lowering the penetration performance.
- When the flange width (Bf) increases, the above-mentioned earth pressure in the groove can be easily released, thereby improving the penetration performance.

As parameters defining the penetration resistance (R), as shown in the expression (3), there are the web angle (θ), the height (H), and the flange width (Bf).

Figure 5:
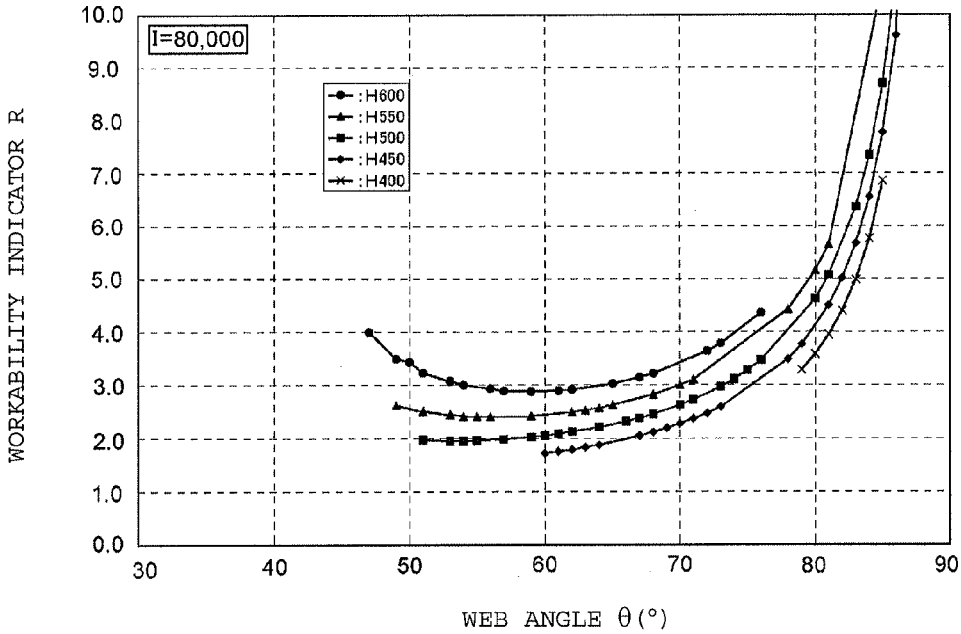
FIG. 5 is a graph for explaining a process for determining a cross section in an embodiment of the present invention, the graph showing the relationship between the workability indicator and the web angle, where I=80,000.

Similar to FIG. 4, FIG. 5 is a graph showing the relationship between the workability indicator (penetration resistance (R)) and the web angle θ (°) at respective heights (H=600, 550, 500, 450) for an example of hat-type steel sheet pile having I=80,000 ($cm^4$/m). In view of FIG. 5, it is found that the web angle θ)(° which minimizes the penetration resistance (R) exists.

As mentioned above, because both the economic efficiency indicator (W/I) and the workability indicator (R) closely relate to the web angle θ (°), these two indicators can be combined to make a single indicator. By doing so, both the economic efficiency and the workability can be evaluated by the single indicator.

As a method of combining the economic efficiency indicator (W/I) and the workability indicator (R), the method of multiplying the both indicators together was adopted.

$$\text{(economic efficiency indicator)}\times\text{(workability indicator)}=\alpha\times(W/I)\times\beta\times(R)$$

Here, α and β are weighting factors for the economic efficiency and the workability, respectively. Note that, here, the method of multiplying the both indicators together is adopted, and it is assumed that α=β=1.

As the economic efficiency indicator (W/I) and the workability indicator (R) decrease, the economic efficiency and the workability become more excellent, respectively. Therefore, when the multiplication value of the indicators decreases, both the economic efficiency and the workability can be judged to be excellent.

Figure 6:
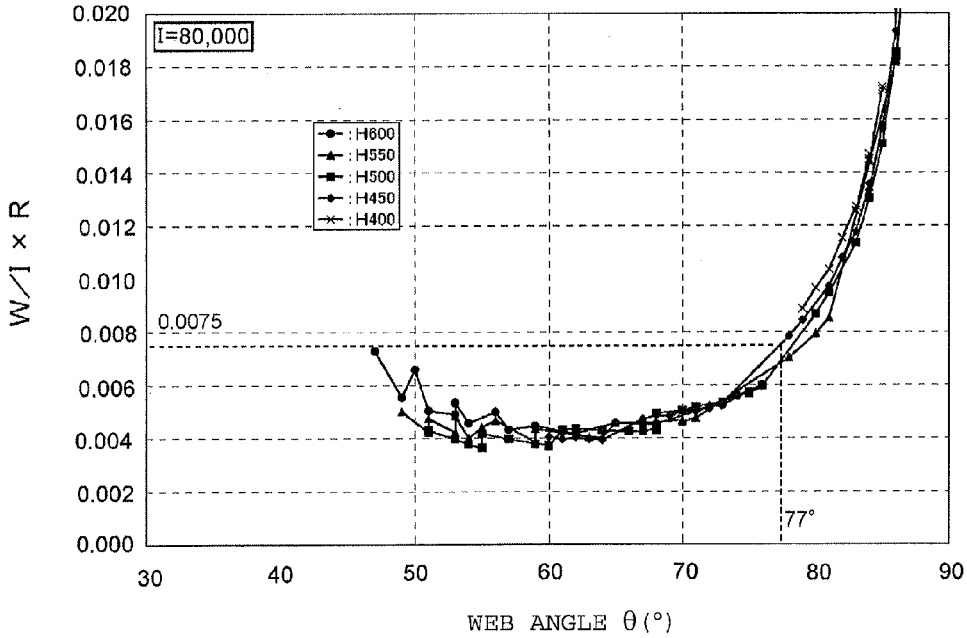
FIG. 6 is a graph for explaining a process for determining a cross section in an embodiment of the present invention, the graph showing the relationship between the indicator taking into account workability and economic efficiency and the web angle, where I=80,000.

FIG. 6 is a graph showing the relationship between the multiplication of the economic efficiency indicator (W/I) and the workability indicator (R), i.e., (W/I)×R, and the web angle θ (°) at respective heights (H=600, 550, 500, 450, 400) in the case that I=80,000 ($cm^4$/m).

As mentioned above, in the graph of FIG. 6, the economic efficiency/workability are judged to be more excellent as the value on the vertical axis decreases, and the point is that how the upper limit (threshold value) should be set.

As a result of examination on this point, an investigation of the above-mentioned steel sheet pile model experiment etc. revealed the value of about 0.004 to 0.0075. Therefore, the web angle θ (°) of about 0.0075 or below is defined as a specification which can ensure both the economic efficiency and the workability.

Note that, in the conventional hat-type steel sheet pile, the multiplication value of both indicators becomes about 0.0081 at 10H, and about 0.0097 at 25H. Accordingly, the steel sheet pile shape has not necessarily been made so as to optimize both the economic efficiency and the workability.

Based on the above-mentioned definition, in FIG. 6, when the range of web angle θ (°) was determined by determining the range of horizontal axis in the case that the vertical axis is 0.0075 or below, at I=80,000 ($cm^4$/m), the web angle θ (°) was found to be desirably set at about 49° to 77° in order to optimize both the economic efficiency and the workability (penetration performance) (refer to FIG. 6). By doing this examination method while changing the level of I to be targeted, there can be determined a cross-sectional shape which can balance the economic efficiency and the workability, and satisfy the respective I to be required.

Table 2 shows a result of preferable ranges of web angle (θ) for respective I which was obtained by doing a similar examination based on a similar procedure as mentioned above.

TABLE 2

| I ($cm^4$/m) | OPTIMIZATIONθ (°) |
|---|---|
| 20,000 | 32 to 69 |
| 40,000 | 40 to 70 |
| 60,000 | 46 to 75 |
| 80,000 | 49 to 77 |
| 100,000 | 52 to 78 |
| 120,000 | 56 to 79 |
| 140,000 | 62 to 78 |
| 160,000 | 69 to 79 |
| 180,000 | 78 |

Figure 7:
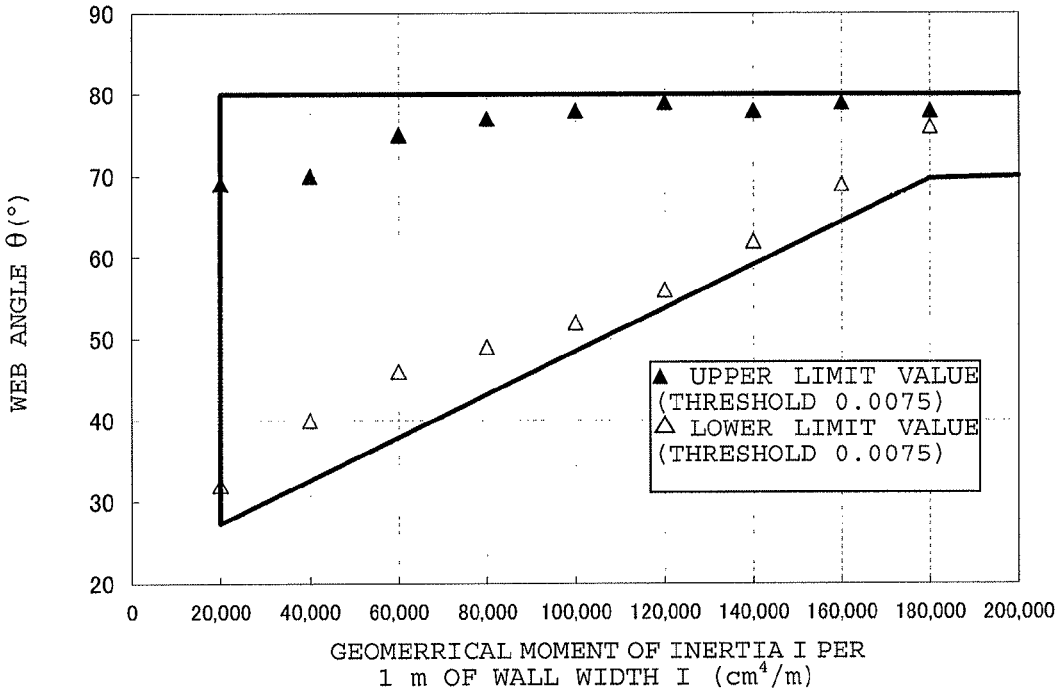
FIG. 7 is a graph showing the relationship between the geometrical moment of inertia per 1 m of wall width and the web angle, when the hat-type steel sheet pile according to an embodiment of the present invention is used to form a steel sheet pile wall.

FIG. 7 is a graph in which the result of Table 2 is shown, while the vertical axis denotes the web angle θ (°), and the horizontal axis denotes I ($cm^4$/m). In FIG. 7, the upper and lower limit values shown in Table 2 are plotted, and fitted by straight lines.

Note that, as mentioned above, the simplified calculation method of the geometrical moment of inertia I used here provides values of about 80 to 90% of the exact solution, so that (W/I)×R shown in FIG. 6 is bigger than the exact solution. When taking into account the fact that the graph of FIG. 6 is convex downward, the preferred range has been judged to be narrower than the case of exact solution because the simplified calculation method was adopted. Therefore, as shown in FIG. 7, when the plot by the simplified calculation method is fitted with straight lines, some deviation may be caused, but the fitted plot has more approached the exact solution so that there is no problem.

The straight lines shown in FIG. 7 are formulated as follows.

$$2.65\times10^{-4}\times I+22\leq\theta\leq80\ (20{,}000\leq I<180{,}000)$$

$$70\leq\theta\leq80\ (180{,}000\leq I<200{,}000) \qquad (4)$$

As mentioned above, the expression (4) has been made taking into account both the economic efficiency and the workability, and the hat-type steel sheet pile satisfying the range of expression (4) is excellent in both the economic efficiency and the workability.

Note that, depending on the condition of the ground into which the hat-type steel sheet pile is to be installed (hardness indicated by N value etc.), the workability may be more important than the economic efficiency, or vice versa.

Namely, when the ground is hard, it may be judged to be acceptable that the penetration resistance is decreased in order to maximize the possibility of installation, and the weight (W) is increased to some extent. On the other hand, when the ground is soft, it may be judged to be advantageous that the weight (W) is decreased, even if the penetration resistance (R) is increased to some extent.

Then, there are described below a shape setting when the workability is considered to be more important, and a shape setting when the economic efficiency is considered to be more important.

<Case in which Workability is More Important>

When the workability is considered to be more important within the range defined by the above-mentioned expression (4), the value of θ needs to be decreased, as can be understood by referring to the expression (3) (R=tan θ×H×2/Bf) which defines the workability. On the other hand, when referring to FIG. 6 which shows the relationship between the workability/economic efficiency and the web angle θ, it can be understood that decreasing the value of θ is equivalent to lowering the threshold value.

Then, as a shape setting when the workability is considered to be more important, an examination similar to that mentioned above was done where the threshold value of (W/I)×R is 0.004 or below. Table 3 shows a calculation result of the web angle θ (°) for respective I when (W/I)×R becomes the threshold value of 0.004.

TABLE 3

| I ($cm^4$/m) | WEB ANGLE θ (°) WHEN (W/I) × R IS THRESHOLD VALUE 0.004 |
|---|---|
| 20,000 | 49 |
| 40,000 | 56 |
| 60,000 | 62 |
| 80,000 | 64 |
| 100,000 | 66 |
| 120,000 | 67 |
| 140,000 | 67 |

Based on the calculation result shown in Table 3, the following expression group (A) is defined.

Expression Group (A):

$$(W/I)\times R\leq 0.004 \text{ and}$$

$$2.65\times10^{-4}\times I+22\leq\theta\leq 2.80\times10^{-4}\times I+48(20{,}000\leq I<80{,}000)$$

$$2.65\times10^{-4}\times I+22\leq\theta\leq 70(80{,}000\leq I<180{,}000)$$

Figure 8:
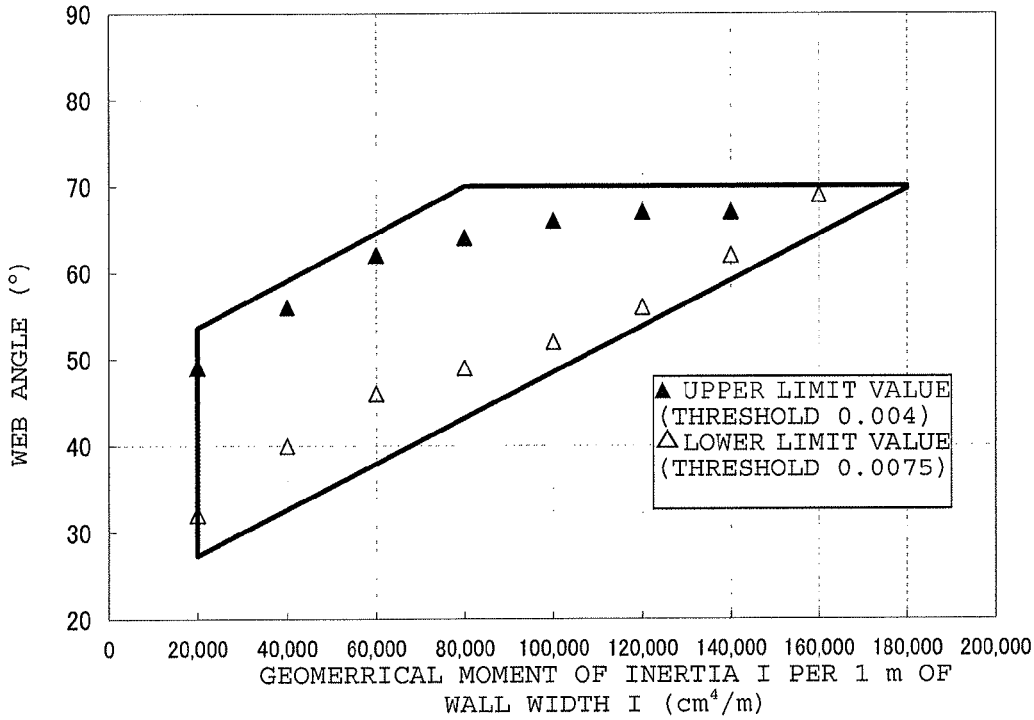
FIG. 8 is a graph showing the relationship between the geometrical moment of inertia per 1 m of wall width and the web angle, when the hat-type steel sheet pile according to another embodiment of the present invention is used to form a steel sheet pile wall.

FIG. 8 shows a graph which is made from the expression group (A).

<Case in which Economic Efficiency is More Important>

When the economic efficiency is considered to be more important, the economic efficiency indicator (W/I) needs to be decreased. As can be understood by referring to FIG. 4, the economic efficiency indicator (W/I) can be decreased by increasing the web angle (θ). On the other hand, by referring to FIG. 6 which shows the relationship between the workability/economic efficiency and the web angle θ, it can be understood that increasing the value of θ is equivalent to increasing the threshold value. Then, as a shape setting when the economic efficiency is considered to be more important, an examination similar to that mentioned above was done where the threshold value of (W/I)×R is in the range of 0.004 to 0.0075, so as to define the following expression group (B).

Expression Group (B):

$$0.004<(W/I)\times R\leq 0.0075 \text{ and}$$

$$2.80\times10^{-4}\times I+44.6<\theta\leq 80(20{,}000\leq I<80{,}000)$$

$$67<\theta\leq 80(80{,}000\leq I<200{,}000)$$

Figure 9:
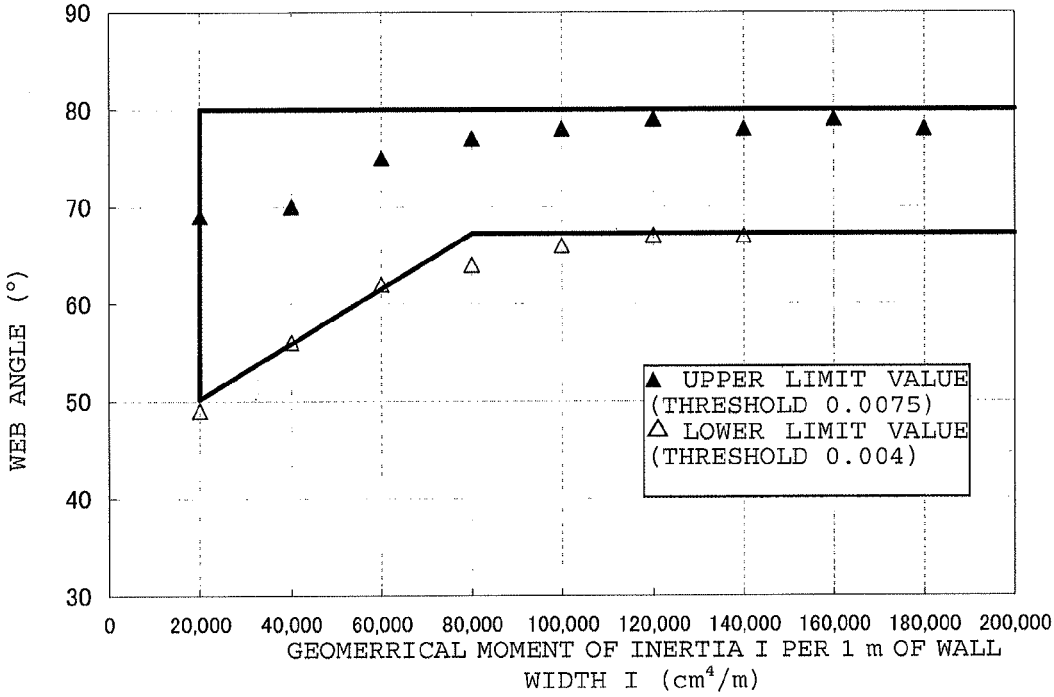
FIG. 9 is a graph showing the relationship between the geometrical moment of inertia per 1 m of wall width and the web angle, when the hat-type steel sheet pile according to another embodiment of the present invention is used to form a steel sheet pile wall.

FIG. 9 shows a graph which is made from the expression group (B).

As mentioned above, when setting a cross-sectional shape of a hat-type steel sheet pile (especially the web angle (θ)), the θ region can be used properly, while basically making the economic efficiency and the workability compatible with each other (expression (4)), and considering the workability more important (expression group (A)), or the economic efficiency more important (expression group (B)).

A hat-type steel sheet pile satisfying the range of the expression (4) is excellent in both the economic efficiency and the workability. A hat-type steel sheet pile satisfying the range of the expression group (A) is excellent in both the economic efficiency and the workability, and further in the workability. A hat-type steel sheet pile satisfying the range of the expression group (B) is excellent in both the economic efficiency and the workability, and further in the economic efficiency.

<Ensuring of Integrity>

In embodiments of the present invention, in addition to those mentioned above, because the relationship between the height (H) and the web steel sheet thickness (tw) is set so as to satisfy the following expression, the buckling/deformation of the steel sheet pile due to the penetration resistance during working can be suppressed so that a hat-type steel sheet pile whose integrity has been ensured can be provided.

$$H/tw\leq 60.0$$

Example 1

As an example of the present invention, a hat-type steel sheet pile having the following specifications was designed.

B=1400 mm, H=540 mm, θ=75°, I=114,810 $cm^4$/m

It was confirmed whether the hat-type steel sheet pile having the above-mentioned specifications was within the range of indicators mentioned above.

When the above-mentioned specifications of the hat-type steel sheet pile are applied to the expression (4) and the expression group (B), the results are as follows.

Expression (4):

$$2.65\times10^{-4}\times I+22\leq\theta\leq 80(20{,}000\leq I<200{,}000)$$

$$2.65\times10^{-4}\times I+22=2.65\times10^{-4}\times 114{,}810+22=52.4$$

52.4<θ=75<80, then, θ is within the range of expression (4)

Expression Group (B):

67<θ≤80(80,000≤I<200,000), θ=75° of the above-mentioned hat-type steel sheet pile is 67<θ=75<80, then, the expression group (B) is satisfied.

Therefore, it can be found that the hat-type steel sheet pile of the above-mentioned example is excellent in the economic efficiency and the workability, and more in the economic efficiency thereof.

Example 2

As an example of the present invention, a hat-type steel sheet pile having the following specifications was designed.

B=1400 mm, H=540 mm, θ=75°, I=81,454 $cm^4$/m

When the above-mentioned specifications of the hat-type steel sheet pile are applied to the expression (4) and the expression group (B), the results are as follows.

Expression (4):

$$2.65\times10^{-4}\times I+22\leq\theta\leq 80(20{,}000\leq I<200{,}000)$$

$$2.65\times10^{-4}\times I+22=2.65\times10^{-4}\times 81{,}454+22=43.6$$

43.6<θ=75<80, then, θ is within the range of expression (4)

Expression Group (B):

67<θ≤80 (80,000≤I<200,000), θ=75° of the above-mentioned hat-type steel sheet pile is 67<θ=75<80, then, the expression group (B) is satisfied.

Therefore, it can be found that the hat-type steel sheet pile of the above-mentioned example is excellent in the economic efficiency and the workability, and more in the economic efficiency thereof.

In the above-mentioned descriptions, the economic efficiency indicator and the workability indicator are multiplied with each other, but the both indicators can be added to each other to be used as an indicator.

In this case, when adding, the weights of both indicators are considered as follows.

$$\text{(economic efficiency indicator)}+\text{(workability indicator)}=\alpha\times(W/I)+\beta\times(R)$$

Because the manufacturing cost and the cross-sectional performance per wall weight (I/W), and the working cost and the reciprocal number of the penetration resistance (1/R), respectively have relationships of conflicting with each other, I/W and 1/R can be used as indicators of the economic efficiency and the workability.

Example 3

As an examination example regarding the method of setting the workability indicator R of the present invention, there is described an example of model working experiment in which a one-twelfth steel sheet pile model (100 cm in length) is pressed into a ground made by Silica sand No. 5 with a constant speed so as to be installed.

Regarding the implementation case of model working experiment, Table 4 shows shapes whose scales are converted to the actual sizes, and the economic efficiency indicator 1/W and the workability indicator R which are determined therefrom. Note that, the shapes are set so that the geometrical moment of inertia I per 1 m of this experimental body for every case becomes about 55,000 ($cm^4/m$).

TABLE 4

IMPLEMENTATION CASE OF MODEL WORKING EXPERIMENT

| | MODEL SHAPE (ACTUAL SIZE CONVERSION) | | | | | VARIOUS INDICATORS (ACTUAL SIZE CONVERSION) | | | | |
|---|---|---|---|---|---|---|---|---|---|---|
| CASE NAME | WEB/FLANGE STEEL SHEET THICKNESS t (mm) | WEB ANGLE θ (°) | HEIGHT H (mm) | FLANGE WIDTH Bf (mm) | WIDTH B (mm) | ECONOMIC EFFICIENCY INDICATOR W/I | WORKABILITY INDICATOR R | TOTAL INDICATOR W/I × R | I ($cm^4/m$) | TOTAL INDICATOR |
| (1)-1 | 9.6 | 36 | 636 | 370 | 1248 | 0.0016 | 1.179 | 0.00194 | 54,181 | ○ |
| (1)-2 | 9.6 | 36 | 636 | 370 | 1248 | 0.0016 | 1.179 | 0.00194 | 54,181 | ○ |
| (2) | 9.6 | 45 | 576 | 454 | 1152 | 0.0017 | 1.270 | 0.00216 | 54,998 | ○ |
| (3)-1 | 9.6 | 60 | 516 | 524 | 1038 | 0.0019 | 1.707 | 0.00322 | 54,200 | ○ |
| (3)-2 | 9.6 | 60 | 516 | 524 | 1038 | 0.0019 | 1.707 | 0.00322 | 54,200 | ○ |
| (4)-1 | 9.6 | 75 | 480 | 534 | 960 | 0.0021 | 3.355 | 0.00698 | 56,032 | X |
| (4)-2 | 9.6 | 75 | 480 | 534 | 960 | 0.0021 | 3.355 | 0.00698 | 56,032 | X |
| (5)-1 | 9.6 | 82 | 456 | 586 | 912 | 0.0022 | 5.544 | 0.01230 | 54,292 | X |
| (5)-2 | 9.6 | 82 | 456 | 586 | 912 | 0.0022 | 5.544 | 0.01230 | 54,292 | X |

Table 5 compares the penetration resistance during working (maximum load) P, and a value of P/P45° which is obtained by normalizing the penetration resistance during working (maximum load) P with the penetration resistance (maximum load) P45° of the case (2) (θ=45°), to the workability indicator R, and a value of R/R45° which is obtained by normalizing the workability indicator R with the workability indicator R45° in the case that θ=45°.

TABLE 5

COMPARISON BETWEEN PENETRATION RESISTANCE DURING WORKING AND WORKING INDICATOR OF MODEL WORKING EXPERIMENT

| | | PENETRATION RESISTANCE DURING WORKING (EXPERIMENT) | | WORKABILITY INDICATOR | |
|---|---|---|---|---|---|
| CASE NAME | EVALUATION OF CONFORMITY TO THE PRESENT INVENTION | WEB ANGLE θ (°) | PENETRATION RESISTANCE (MAXIMUM LOAD) P (kN) | NORMALIZATION P/P45° | WORKABILITY INDICATOR R | NORMALIZATION R/R 45° |
| (1)-1 | ○ | 36 | 0.67 | 1.19 | 1.179 | 0.90 |
| (1)-2 | ○ | 36 | 0.7 | 1.24 | 1.179 | 0.90 |
| (2) | ○ | 45 | 0.46 | 1.00 | 1.270 | 1.00 |
| (3)-1 | ○ | 60 | 0.49 | 1.33 | 1.707 | 1.34 |
| (3)-2 | ○ | 60 | 0.42 | 1.14 | 1.707 | 1.34 |
| (4)-1 | X | 75 | 0.78 | 2.62 | 3.355 | 2.69 |
| (4)-2 | X | 75 | 0.73 | 2.45 | 3.355 | 2.69 |
| (5)-1 | X | 82 | 1.08 | 3.84 | 5.544 | 4.46 |
| (5)-2 | X | 82 | 1.29 | 4.58 | 5.544 | 4.46 |

Figure 10:
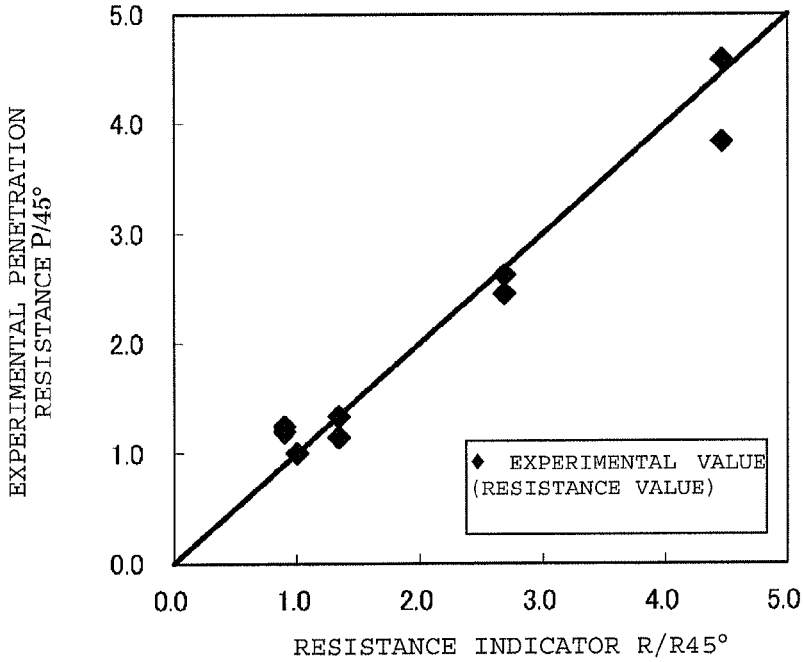
FIG. 10 is a graph showing the relationship between the normalized penetration resistance during working (maximum load) P/P45° and the workability indicator R/R45°.

FIG. 10 shows the relationship between the normalized penetration resistance during working (maximum load) P/P45° and the normalized workability indicator R/R45°. The two correspond to each other well so that the present workability indicator has been confirmed to be valid.

Figure 11:
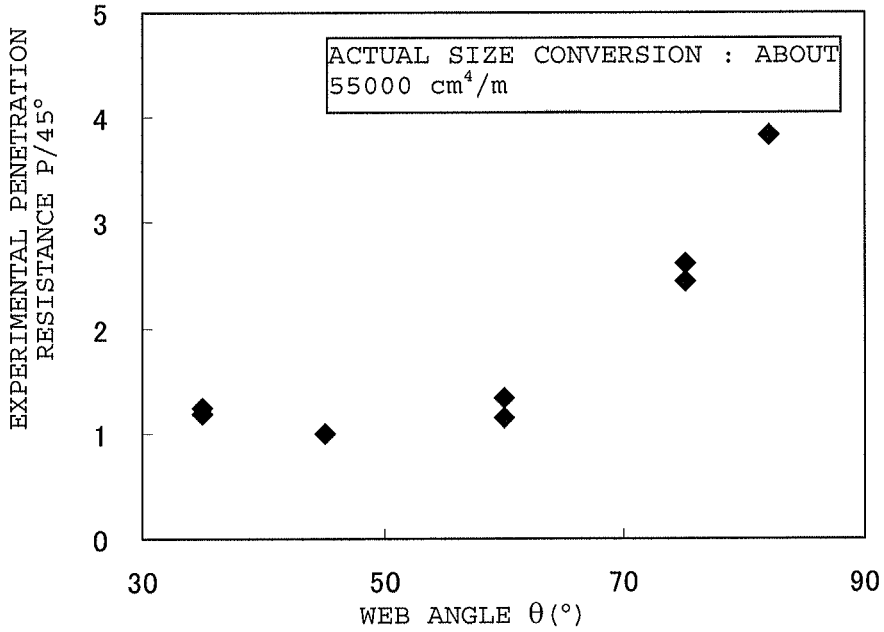
FIG. 11 is a graph showing the relationship between the normalized penetration resistance during working (maximum load) P/P45° and the web angle θ (°).

FIG. 11 shows the relationship between the normalized penetration resistance during working (maximum load) P/P45° and the web angle θ (°). While in an exemplary range of the present invention (36.6°≤θ≤63.4°), the penetration resistance during working in the experiment is relatively suppressed, in out of the exemplary range of the present invention (θ=75°, 82°), the penetration resistance during working increases.

Example 4

As an examination example regarding the method of setting the workability indicator R of the present invention, there is described an example of model working experiment in which a one-twelfth steel sheet pile model (100 cm in length) is pressed into a ground made by Silica sand No. 5 with a constant speed so as to be installed.

Regarding the implementation case of model working experiment, Table 6 shows shapes whose scales are converted to the actual sizes, and the economic efficiency indicator 1/W and the workability indicator R which are determined therefrom. Note that, the shapes are set so that the geometrical moment of inertia I per 1 m of this experimental body for every case becomes about 82,000 ($cm^4$/m).

TABLE 6

| | MODEL SHAPE (ACTUAL SIZE CONVERSION) | | | | | VARIOUS INDICATORS (ACTUAL SIZE CONVERSION) | | | | |
|---|---|---|---|---|---|---|---|---|---|---|
| CASE NAME | WEB/ FLANGE STEEL SHEET THICKNESS t (mm) | WEB ANGLE θ (°) | HEIGHT H (mm) | FLANGE WIDTH Bf (mm) | WIDTH B (mm) | ECONOMIC EFFICIENCY INDICATOR W/I | WORKABIL-ITY INDICATOR R | TOTAL INDICATOR W/I × R | I ($cm^4$/m) | EVALUATION OF CONFORMITY TO THE PRESENT INVENTION |
| (6) | 9.6/16.8 | 67 | 496 | 492 | 1392 | 0.0018 | 2.372 | 0.00433 | 82,028 | EXPRESSION GROUP (B) CONFORMED |
| (7) | 9.6/16.8 | 70 | 484 | 526 | 1392 | 0.0019 | 2.528 | 0.00475 | 81,781 | EXPRESSION GROUP (B) CONFORMED |
| (8) | 9.6/16.8 | 75 | 468 | 576 | 1392 | 0.0020 | 3.037 | 0.00594 | 81,615 | EXPRESSION GROUP (B) CONFORMED |
| (9) | 9.6/16.8 | 85 | 444 | 658 | 1392 | 0.0021 | 7.705 | 0.01618 | 81,567 | X |

Table 7 compares the penetration resistance during working (maximum load) P, a value of P/P67° which is obtained by normalizing the penetration resistance during working (maximum load) P with the penetration resistance (maximum load) P67° of the case (6) (δ=67°), the workability indicator R, and a value of R/R67° which is obtained by normalizing the workability indicator R with the workability indicator R67° in the case that θ=67°.

TABLE 7

COMPARISON BETWEEN PENETRATION RESISTANCE DURING WORKING AND WORKING INDICATOR OF MODEL WORKING EXPERIMENT

| | | PENETRATION RESISTANCE DURING WORKING (EXPERIMENT) | | | WORKABILITY INDICATOR | |
|---|---|---|---|---|---|---|
| CASE NAME | EVALUATION OF CONFORMITY TO THE PRESENT INVENTION | WEB ANGLE θ (°) | PENETRATION RESISTANCE (MAXIMUM LOAD) P (kN) | NORMALIZATION P/P67 | WORKABILITY INDICATOR R | NORMALIZATION R/R67° |
| (6) | ○ | 67 | 0.75 | 1.00 | 2.372 | 1.00 |
| (7) | ○ | 70 | 0.74 | 0.99 | 2.528 | 1.07 |
| (8) | ○ | 75 | 0.92 | 1.28 | 3.037 | 1.32 |
| (9) | X | 85 | 2.1 | 2.80 | 7.705 | 3.34 |

Figure 12:
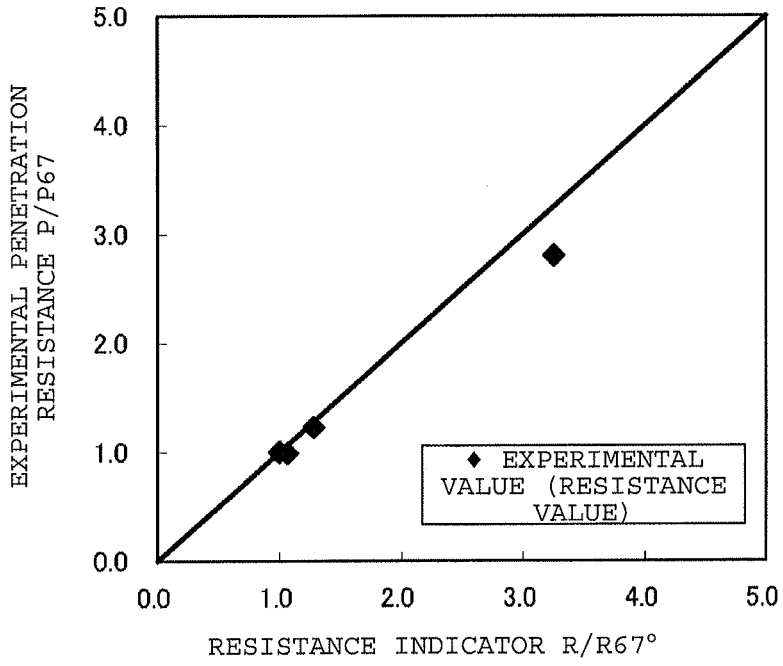
FIG. 12 is a graph showing the relationship between the normalized penetration resistance during working (maximum load) P/P67° and the workability indicator R/R67°.

FIG. 12 shows the relationship between the normalized penetration resistance during working (maximum load) P/P67° and the normalized workability indicator R/R67°. The two correspond to each other well so that the present workability indicator has been confirmed to be valid.

Figure 13:
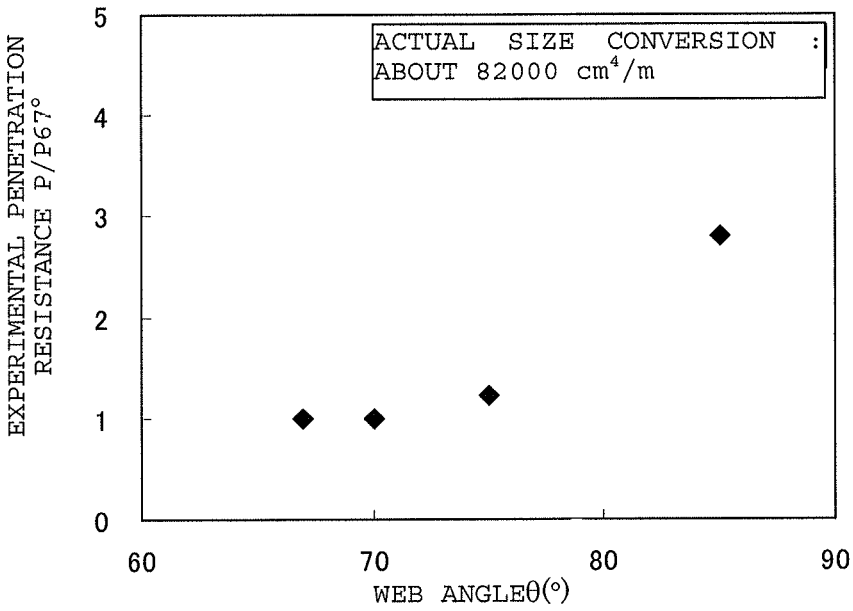
FIG. 13 is a graph showing the relationship between the normalized penetration resistance during working (maximum load) P/P67° and the web angle θ (°).

FIG. 13 shows the relationship between the normalized penetration resistance during working (maximum load) P/P67° and the web angle θ (°). While in the exemplary range of the present invention (67°≤θ≤80°), the penetration resistance during working in the experiment is relatively suppressed, in out of the exemplary range of the present invention (θ=85°), the penetration resistance during working increases.

Example 5

As an example of the present invention, there is described an example of model working experiment in which a 1/8.5 scale steel sheet pile model (110 cm in length) is pressed into a ground made by Silica sand No. 7 with a constant speed so as to be installed.

Regarding the implementation case of model working experiment, Table 8 shows shapes whose scales are converted to the actual sizes, and the penetration resistance value P.

The invention claimed is:

1. A hat-type steel sheet pile in which web portions are continuously formed at both ends of an upper flange portion, and lower flange portions are formed at respective end portions of a pair of web portions, wherein a relationship among a geometrical moment of inertia I per 1 m of wall width ($cm^4/m$) when forming a steel sheet pile wall, a weight per unit wall area W ($kg/m^2$), a penetration resistance R, and a web angle θ (°) is set to satisfy one of following expression groups (A) and (B), the expression group (A):

$(W/I)\times R\leq 0.004$ and $2.65\times10^{-4}\times I+22\leq\theta\leq 2.80\times10^{-4}\times I+48(20{,}000\leq I<80{,}000)$ $2.65\times10^{-4}\times I+22\leq\theta\leq 70(80{,}000\leq I<180{,}000)$ the expression group (B):

$0.004<(W/I)\times R\leq 0.0075$ and $2.80\times10^{-4}\times I+44.6<\theta\leq 80(20{,}000\leq I<80{,}000)$ $67<\theta\leq 80(80{,}000\leq I<200{,}000)$.

TABLE 8

IMPLEMENTATION CASE OF MODEL WORKING EXPERIMENT

| | MODEL SHAPE (ACTUAL SIZE CONVERSION) | | | | | | | EXPERIMENTAL RESULT | | EVALUATION OF CONFORMITY TO THE PRESENT INVENTION |
|---|---|---|---|---|---|---|---|---|---|---|
| CASE NAME | WEB STEEL SHEET THICKNESS Tw (mm) | FLANGE STEEL SHEET THICKNESS tf (mm) | WEB ANGLE θ (°) | HEIGHT H (mm) | FLANGE WIDTH Bf (mm) | OVERALL WIDTH B (mm) | HEIGHT/WEB THICKNESS RATIO H/tw | PENETRATION RESISTANCE P (kN) | DEFORMATION AMOUNT (°) | |
| (1) | 8.5 | 17.0 | 75 | 544 | 552 | 1400 | 64.0 | 16.28 | 15.2 | X |
| (2) | 9.0 | 17.0 | 75 | 544 | 552 | 1400 | 60.4 | 14.22 | 6.6 | ○ |
| (3) | 10.2 | 17.0 | 75 | 544 | 552 | 1400 | 53.3 | 13.68 | 2.5 | ○ |
| (4) | 12.8 | 17.0 | 75 | 544 | 552 | 1400 | 42.7 | 13.51 | 5.1 | ○ |
| (5) | 16.0 | 17.0 | 75 | 544 | 552 | 1400 | 32.0 | 13.24 | 0.9 | ○ |

Figure 14:
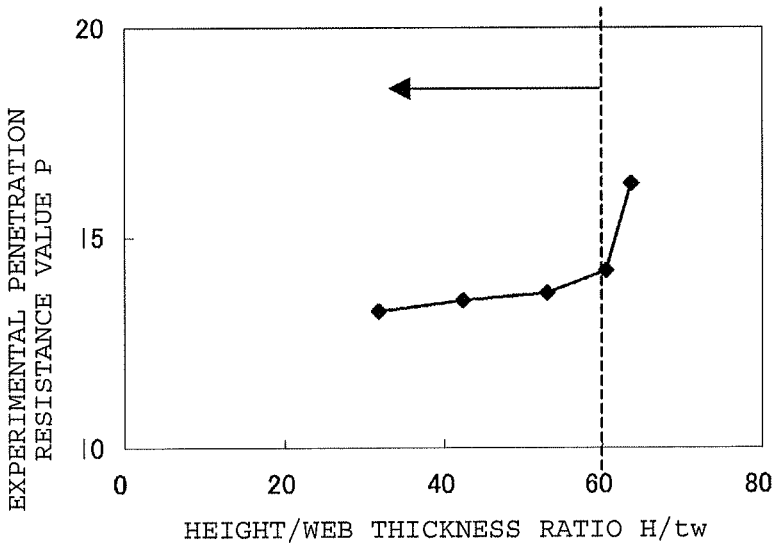
FIG. 14 is a graph showing the relationship between the penetration resistance P during working and H/tw which is the ratio of height/web thickness.

FIG. 14 shows a relationship between the penetration resistance P during working and the height/web thickness ratio H/tw. The penetration resistance increases at around 60 of the height/web thickness ratio H/tw. Accordingly, the deformation can be controlled by suppressing the height/web thickness ratio H/tw at around 60, and there is no fear of lowering the workability.

Figure 15:
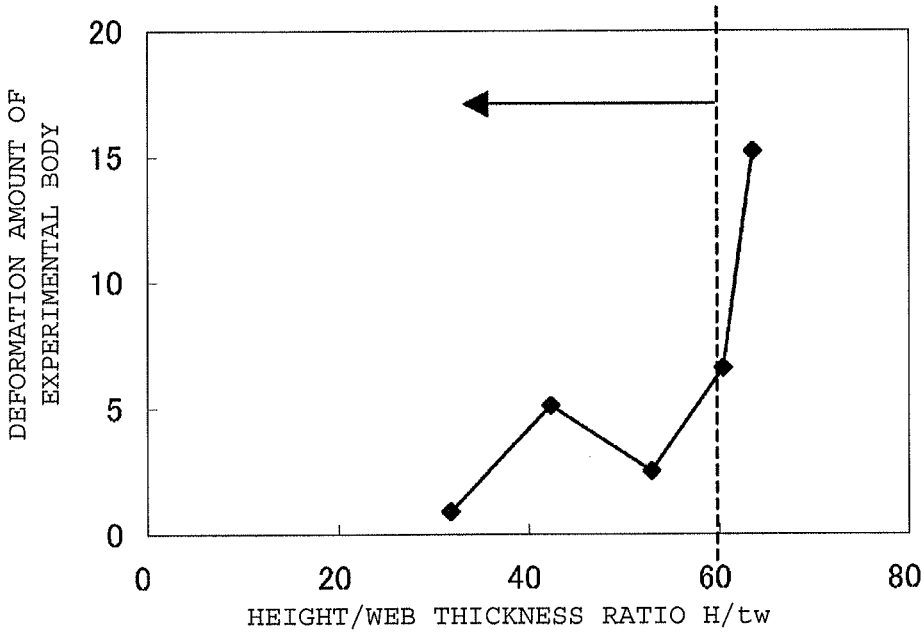
FIG. 15 is a graph showing the relationship between the deformation amount of an experimental body and H/tw which is the ratio of height/web thickness.

FIG. 15 shows the relationship between the deformation amount of the experimental body and the height/web thickness ratio H/tw. The deformation amount of the experimental body shows the amount of change of the intersecting angle between the web and the flange. The deformation amount of the experimental body becomes large at around the value of 60 of the height/web thickness ratio. The deformation amount can be controlled by suppressing the height/web thickness ratio H/tw at around 60.

2. The hat-type steel sheet pile according to claim 1, wherein the relationship is set to satisfy the expression group (A).

3. The hat-type steel sheet pile according to claim 1, wherein the relationship is set to satisfy the expression group (B).

4. The hat-type steel sheet pile according to claim 1, wherein a relationship between the height (H) and the web steel sheet thickness (tw) satisfies a following expression:

$H/tw\leq 60.0$.

* * * * *